US008894359B2

(12) United States Patent
Munshi et al.

(10) Patent No.: US 8,894,359 B2
(45) Date of Patent: Nov. 25, 2014

(54) GAS TURBINE ENGINE WITH OUTER CASE AMBIENT EXTERNAL COOLING SYSTEM

(75) Inventors: Mrinal Munshi, Orlando, FL (US); John Finneran, Palm Beach Gardens, FL (US); Ching-Pang Lee, Cincinnati, OH (US); Yevgeniy Shteyman, West Palm Beach, FL (US); Daryl Graber, Palm Beach Gardens, FL (US); Matthew R. Porter, West Palm Beach, FL (US); Jonathan M. Leagon, Cassatt, SC (US)

(73) Assignee: Siemens Aktiengesellschaft, München (DE)

( * ) Notice: Subject to any disclaimer, the term of this patent is extended or adjusted under 35 U.S.C. 154(b) by 439 days.

(21) Appl. No.: 13/314,311

(22) Filed: Dec. 8, 2011

(65) Prior Publication Data

US 2013/0149120 A1 Jun. 13, 2013

(51) Int. Cl.
*F01D 25/12* (2006.01)
*F01D 25/14* (2006.01)

(52) U.S. Cl.
USPC ..... 415/142; 415/175; 415/178

(58) Field of Classification Search
CPC ..... F01D 9/04; F01D 9/065; F01D 25/14; F01D 25/145; F01D 25/162
USPC ..... 415/142, 170.1, 175, 177, 178, 213.1, 415/229
See application file for complete search history.

(56) References Cited

U.S. PATENT DOCUMENTS 2,402,841 A * 6/1946 Ray ..... 415/47
2,744,722 A * 5/1956 Orr ..... 415/115
3,034,298 A 5/1962 White
3,077,074 A 2/1963 Collman et al.
4,156,342 A * 5/1979 Korta et al. ..... 60/39.08
4,355,507 A * 10/1982 Coffey et al. ..... 60/39.5
4,987,736 A * 1/1991 Ciokajlo et al. ..... 60/797
5,176,495 A * 1/1993 Honkomp et al. ..... 415/173.1
5,388,960 A * 2/1995 Suzuki et al. ..... 415/176
5,628,182 A 5/1997 Mowill
5,669,812 A * 9/1997 Schockemoehl et al. ..... 454/45
5,680,767 A 10/1997 Lee et al.
5,980,201 A * 11/1999 Benoist et al. ..... 415/115
6,035,929 A * 3/2000 Friedel et al. ..... 165/168
6,122,917 A 9/2000 Senior
6,149,074 A * 11/2000 Friedel et al. ..... 239/127.1
6,295,803 B1 10/2001 Bancalari
6,478,534 B2 * 11/2002 Bangert et al. ..... 415/1
6,584,766 B1 * 7/2003 Czachor ..... 60/266
6,786,052 B2 * 9/2004 Doody ..... 60/796
7,040,097 B2 5/2006 Mukherjee
7,273,345 B2 * 9/2007 Birrell et al. ..... 415/1
7,329,084 B2 * 2/2008 Dittmann et al. ..... 415/1
7,682,130 B2 * 3/2010 Jurjevic ..... 415/175
7,766,610 B2 * 8/2010 Busekros et al. ..... 415/144

(Continued)

*Primary Examiner* — Edward Look
*Assistant Examiner* — Sean J Younger

(57) ABSTRACT

A thermal barrier/cooling system for controlling a temperature of an outer case of a gas turbine engine. The thermal barrier/cooling system includes an internal insulating layer supported on an inner case surface, the internal insulating layer extending circumferentially along the inner case surface and providing a thermal resistance to radiated energy from structure located radially inwardly from the outer case. The thermal barrier/cooling system further includes a convective cooling channel defined by a panel structure located in radially spaced relation to an outer case surface of the outer case and extending around the circumference of the outer case surface. The convective cooling channel forms a flow path for an ambient air flow cooling the outer case surface.

20 Claims, 5 Drawing Sheets

(56) References Cited

U.S. PATENT DOCUMENTS

2006/0073010 A1 4/2006 Busekros et al.
2010/0068043 A1 3/2010 Shteyman et al.
2010/0272558 A1* 10/2010 Black et al. ..... 415/142
2011/0005234 A1* 1/2011 Hashimoto et al. ..... 60/796

* cited by examiner

GAS TURBINE ENGINE WITH OUTER CASE AMBIENT EXTERNAL COOLING SYSTEM

FIELD OF THE INVENTION

The present invention relates to gas turbine engines and, more particularly, to structures for providing thermal protection to limit heating of the outer case of a gas turbine engine.

BACKGROUND OF THE INVENTION

A gas turbine engine generally includes a compressor section, a combustor section, a turbine section and an exhaust section. In operation, the compressor section may induct ambient air and compress it. The compressed air from the compressor section enters one or more combustors in the combustor section. The compressed air is mixed with the fuel in the combustors, and the air-fuel mixture can be burned in the combustors to form a hot working gas. The hot working gas is routed to the turbine section where it is expanded through alternating rows of stationary airfoils and rotating airfoils and used to generate power that can drive a rotor. The expanded gas exiting the turbine section may then be exhausted from the engine via the exhaust section.

In a typical gas turbine engine, bleed air comprising a portion of the compressed air obtained from one or more stages of the compressor may be used as cooling air for cooling components of the turbine section. Additional bleed air may also be supplied to portions of the exhaust section, such as to cool portions of the exhaust section and maintain a turbine exhaust case below a predetermined temperature through a forced convection air flow provided within an outer casing of the engine. Advancements in gas turbine engine technology have resulted in increasing temperatures, and associated outer case deformation due to thermal expansion. Case deformation may increase stresses in the case and in components supported on the case within the engine, such as bearing support struts. The additional stress, which may operate in combination with low cycle fatigue, may contribute to cracks, fractures or failures of the bearing support struts that are mounted to the casing for supporting an exhaust end bearing housing.

SUMMARY OF THE INVENTION

In accordance with an aspect of the present invention, a gas turbine engine is provided comprising an outer case defining a central longitudinal axis, and an outer case surface extending circumferentially around the central longitudinal axis. A thermal barrier/cooling system is provided for controlling a temperature of the outer case. The thermal barrier/cooling system includes an internal insulating layer supported on an inner case surface opposite the outer case surface, the internal insulating layer extending circumferentially along the inner case surface and providing a thermal resistance to radiated energy from structure located radially inwardly from the outer case. The thermal barrier/cooling system further includes a convective cooling channel defined by a panel structure located in radially spaced relation to the outer case surface and extending around the circumference of the outer case surface. The convective cooling channel is generally axially aligned with the internal insulating layer and forms a flow path for an ambient air flow cooling the outer case surface.

In accordance with further aspects of the invention, the convective cooling channel may include a cooling air supply inlet at a first circumferential location, and an exhaust air outlet at a second circumferential location diametrically opposite from the first circumferential location. The axis of the outer case may extend in a generally horizontal direction, and the air supply inlet may be located at a bottom-dead-center location of the outer case and the exhaust air outlet may be located at a top-dead-center location of the outer case. Auxiliary air inlets may be located about midway between the first and second circumferential locations on opposing sides of the outer case, and cover plates may be located over the auxiliary air inlets, the cover plates being displaceable from the auxiliary air inlets to permit entry of ambient air into the cooling channel through one or more of the auxiliary air inlets. Further, an external insulating layer may be provided supported on and covering the panel structure.

The panel structure may comprise a plurality of circumferentially located panel segments joined at axially extending joints, the air flow through the cooling channel may create a pressure lower than an ambient air pressure such that any air leakage through the joints may comprise leakage of ambient air into the cooling structure.

The internal insulating layer may comprise a plurality of circumferentially located separately mounted insulating layer segments.

The outer case may comprise a turbine exhaust case, and may include an exhaust diffuser defining the structure located radially inwardly from the outer case at the axial location of the internal insulating layer.

In accordance with another aspect of the invention, a gas turbine engine is provided comprising an outer case comprising a turbine exhaust case defining a central longitudinal axis extending in a generally horizontal direction, and an outer case surface extending circumferentially around the central longitudinal axis. A thermal barrier/cooling system is provided for controlling a temperature of the outer case. The thermal barrier/cooling system includes an internal insulating layer supported on an inner case surface opposite the outer case surface, the internal insulating layer extending circumferentially along the inner case surface and providing a thermal resistance to radiated energy from an exhaust diffuser located radially inwardly from the outer case. The thermal barrier/cooling system further includes a convective cooling channel including at least a first portion defined by a panel structure located in radially spaced relation to the outer case surface and extending around the circumference of the outer case surface. The convective cooling channel is generally axially aligned with the internal insulating layer and forms a flow path for directing an ambient non-forced air flow in an upward direction to cool the outer case surface.

In accordance with additional aspects of the invention, the insulating layer segments may comprise a plurality of circumferentially located separately mounted insulating layer segments, and may each comprise a pair of sheet metal layers and a thermal blanket layer located between the sheet metal layers, the thermal blanket layer having a lower thermal conductivity, i.e., a higher thermal resistance, than the sheet metal layers.

Bearing support struts may extend from the outer case, and through the internal insulating layer and the exhaust diffuser.

The internal insulating layer may have a thermal conductivity of about 0.15 W/m·K or less.

The exhaust case may include an exhaust case flange, and the gas turbine engine may further include a spool structure having a spool structure flange forming a joint to the exhaust case flange. The thermal barrier/cooling system may comprise a second internal insulating layer supported on an inner surface of the spool structure, the internal insulating layer extending circumferentially along the inner surface of the spool structure and providing a thermal resistance to radiated energy from the exhaust diffuser. The panel structure of the thermal barrier/cooling system may extend past the joint between the exhaust case flange and the spool structure flange to form a second portion of the convective cooling channel extending around the circumference of the spool structure, and the further convective cooling channel may be generally axially aligned with the second internal insulating layer and form a second flow path for directing an ambient non forced air flow in an upward direction to cool the spool structure surface.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
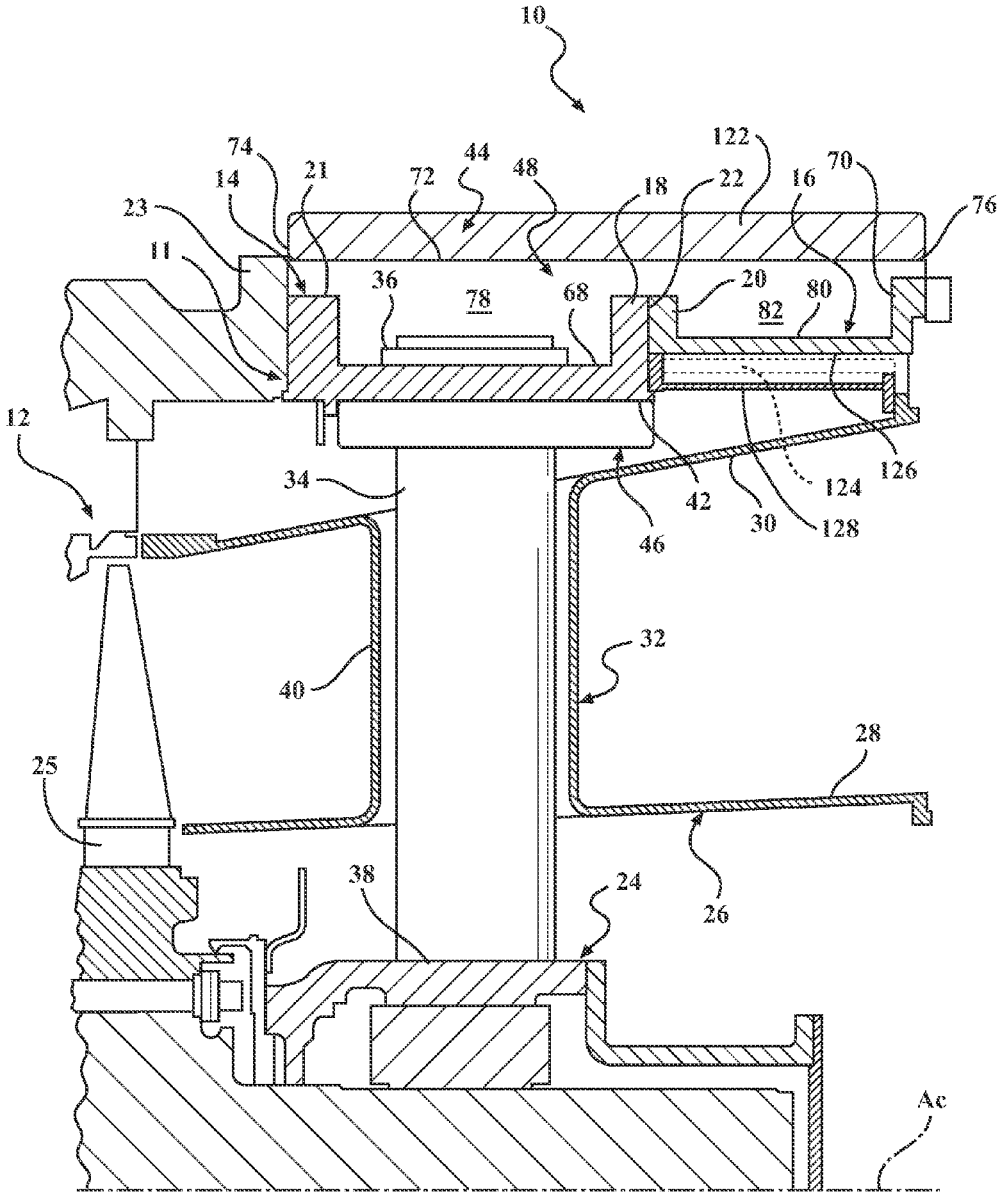
FIG. 1 is a cross-sectional elevational view through a portion of a gas turbine engine including an exhaust section illustrating aspects of the present invention.

Referring to FIG. 1, a portion of an exhaust section 10 of a gas turbine engine is shown located axially downstream from a turbine section 12 to illustrate aspects of the present invention. The exhaust section 10 generally comprises a cylindrical structure comprising an outer case 11 extending circumferentially around a generally horizontal central longitudinal axis $A_C$ and forms a downstream extension of an outer case the gas turbine engine. The outer case 11 of the exhaust section 10 includes an exhaust cylinder or turbine exhaust case 14, and an exhaust spool structure 16 located downstream from the exhaust case 14.

The exhaust case 14 includes a downstream exhaust case flange 18 that extends radially outwardly of a downstream end the exhaust case 14, and the spool structure 16 includes an upstream spool structure flange 20 that extends radially outwardly of the spool structure 16. The downstream exhaust case flange 18 and upstream spool structure flange 20 abut each other at a joint 22, and may be held together in a conventional manner, such as by bolts (not shown). In addition, an upstream exhaust case flange 21 extends radially outwardly from an upstream end of the exhaust case 14 and may be bolted to a radially extending flange 23 of the turbine section 12 for supporting the exhaust case 14 to the turbine section 12.

The exhaust case 14 comprises a relatively thick wall forming a structural member or frame for supporting an exhaust end bearing housing 24 and for supporting at least a portion of an exhaust diffuser 26. The exhaust end bearing housing 24 is located for supporting an end of a rotor 25 for the gas turbine engine.

The diffuser 26 comprises an inner wall 28 and an outer wall 30 defining an annular passage for conveying hot exhaust gas from the turbine section 12. The bearing housing 24 is supported by a plurality of strut structures 32. Each of the strut structures 32 include a strut 34 extending from a connection 36 on the exhaust case 14, through the diffuser 26, to a connection 38 on the bearing housing 24 for supporting and maintaining the bearing housing 24 at a centered location within the exhaust case 14. The strut structures 32 may additionally include a fairing 40 surrounding the strut 34 for isolating the strut 34 from the hot exhaust gases passing through the diffuser 26, see also FIG. 3.

As a result of the hot exhaust gases passing through the diffuser 26, the outer wall 30 of the diffuser 26 radiates heat radially outwardly toward an inner case surface 42 of the exhaust case 14. As discussed above, conventional designs for cooling a turbine exhaust section may provide bleed air supplied from a compressor section of the engine to the exhaust section to provide a flow of cooling air between the diffuser and the exhaust case in order to control or reduce the temperature of the exhaust case through forced convection. In accordance with an aspect of the invention, a thermal barrier/cooling system 44 is provided to reduce and/or eliminate the use of compressor bleed air to control the temperature of the exhaust case 14 and spool structure 16.

Figure 2:
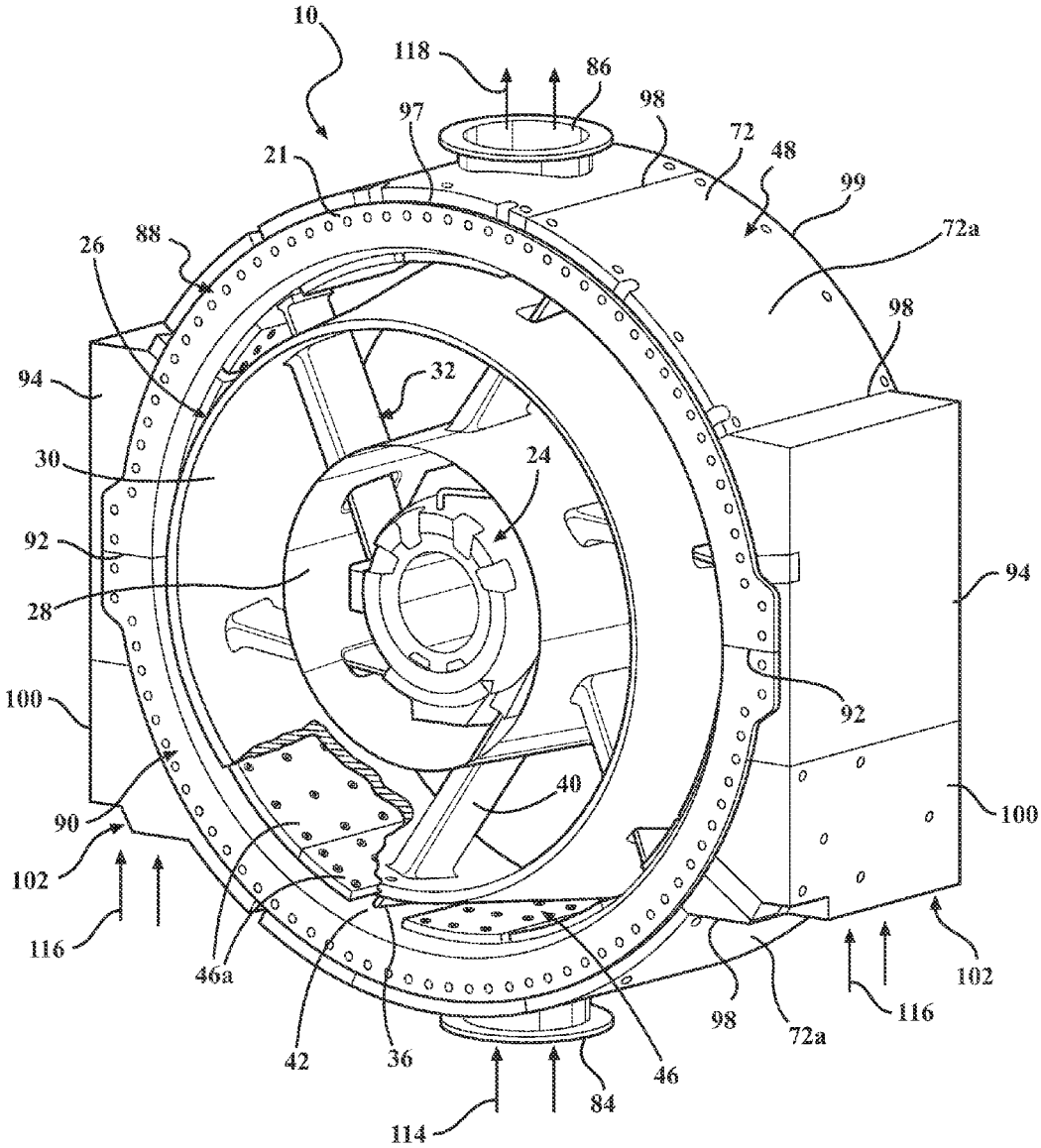
FIG. 2 is a partially cut-away perspective view of the exhaust section illustrating aspects of the present invention.
Figure 3:
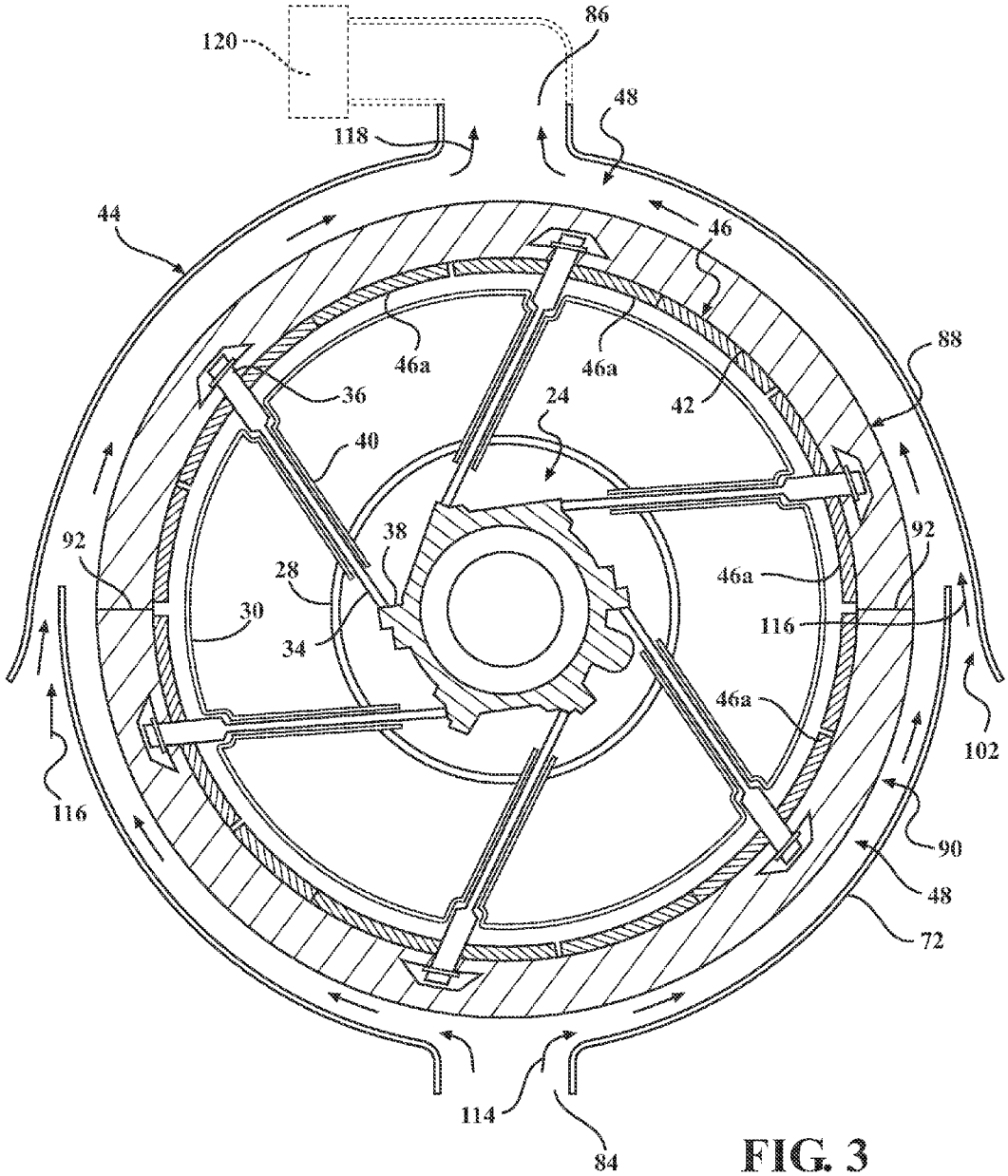
FIG. 3 is a cross-sectional axial view of the exhaust section diagrammatically illustrating air flow provided around an outer case of the gas turbine engine.

Referring to FIGS. 2 and 3, the thermal barrier/cooling system 44 generally comprises an internal insulating layer 46 and a convective cooling channel 48. The internal insulating layer 46 is supported on the inner case surface 42 and extends circumferentially to cover substantially the entire inner case surface 42. The internal insulating layer 46 forms a thermal barrier between the diffuser 26 and the exhaust case 14 to provide a thermal resistance to radiated energy from the outer wall 30 of the diffuser 26.

The internal insulating layer 46 is preferably formed by a plurality of insulating layer segments 46*a* (FIG. 5) generally located in side-by-side relation to each other, and having a longitudinal or axial extent that is about equal to the axial length of the exhaust case 14 to provide a thermal barrier across substantially the entire inner case surface 42 of the exhaust case 14. Hence, a substantial portion of the radiated heat from the diffuser 26 is prevented from reaching the exhaust case 14, thereby isolating the wall of the exhaust case 14 from the thermal load contained within the exhaust case 14.

Figure 5:
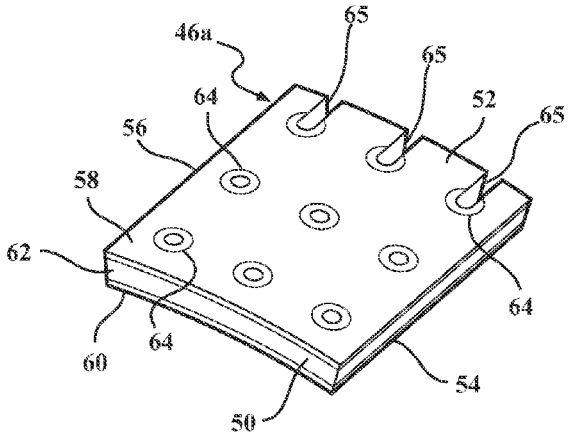
FIG. 5 is a perspective view illustrating an insulating layer segment in accordance with an aspect of the invention.

Referring further to FIG. 5, the insulating layer segments 46*a* may comprise rectangular segment members having a leading edge 50, a trailing edge 52, and opposing side edges 54, 56. The insulating layer segments 46*a* have a lower thermal conductivity than that of the wall of the exhaust case 14. The thermal conductivity of the insulating layer segments 46*a* may have a maximum value of about 0.15 W/m·K, and preferably have a thermal conductivity value of about 0.005 W/m·K for resisting transfer of heat from the diffuser to the engine case 14. The insulating layer segments 46*a* may positioned on the inner case surface 42 of the exhaust case 14 with the side edges 54, 56 of one insulating layer segment 46*a* closely adjacent, or engaged with, the side edges 54, 56 of an adjacent insulating layer segment 46*a*.

The construction of the insulating layer segments 46*a* may comprise a pair of opposing sheet metal layers 58, 60, and a thermal blanket layer 62 located between the sheet metal layers 58, 60 and having a substantially lower thermal conductivity than the sheet metal layers 58, 60. A plurality of metal bushings 64 may extend through the sheet metal layers 58, 60 and the thermal blanket layer 62 at mounting points for the insulating layer segments 46*a*. In particular, each of the metal bushings 64 comprise a rigid structure defining a predetermined spacing between the sheet metal layers 58, 60, and are adapted to receive a fastener structure, such as a standoff 66 (FIG. 4), for attaching each insulating layer segment 46*a* to the exhaust case 14. The standoffs 66 may be configured to permit limited movement of the insulating layer segments 46*a* relative to the inner case surface 42, such as to provide for any thermal mismatch between the internal insulating layer 46 and the exhaust case 14. For example the standoffs 66 may each comprise a stud 67 having a radially outer end affixed at the inner case surface 42 and having a threaded radially inner end for receiving a nut 69 to retain the insulating layer segment 46*a* between the nut and the inner case surface 42.

The insulating layer segments 46*a* may be provided with slots 65 extending from the trailing edge 52 to a rear row of the bushings 64 to facilitate assembly of the insulating layer segments 46*a* to the exhaust case 14. In particular, the slots 65 facilitate movement of the insulating layer segments 46*a* onto the studs 67 during assembly by permitting a degree of axial movement of the rear row of bushings 64 onto a corresponding row of studs 67 at a rear portion of the exhaust case 14 where there is a minimal space between the exhaust case 14 and the diffuser 26.

It may be noted that a limited spacing may be provided between adjacent insulating layer segments 46*a* at particular locations around the inner case surface 42. For example, at the locations of the connections 36 where the struts 34 extend inwardly from the inner case surface 42 a spacing or gap may be provided between adjacent insulating layer segments 46*a* located adjacent to either side of each strut 34. Similarly, a limited gap may be present between the insulating layer segments 46*a* that are directly adjacent to structure forming the horizontal joints 92. It may be noted that an alternative configuration of the insulating layer segments 46*a* may be provided to reduce gaps at these locations. For example, the insulating layer segments 46*a* may be configured to include portions that extend closely around the struts 34 and thereby reduce gap areas that may expose the inner case surface 42 to radiated heat.

Provision of multiple insulating layer segments 46*a* facilitates assembly of the internal insulating layer 46 to the engine case 14, and further enables repair of a select portion of the internal insulating layer 46. For example, in the event of damage to a portion of the internal insulating layer 46, the configuration of the internal insulating layer 46 permits removal and replacement of individual ones of the insulating layer segments 46*a* that may have damage, without requiring replacement of the entire internal insulating layer 46.

It should be understood that although a particular construction of the insulating layer segments 46*a* has been described, other materials and constructions for the insulating layer segments 46*a* may be provided. For example, the insulating layer segments 46*a* may be formed of a known ceramic insulating material configured to provide a thermal resistance for surfaces, such as the inner case surface 42.

Referring to FIG. 1, the convective cooling channel 48 extends circumferentially around an outer case surface 68 of the exhaust case 14, and is generally axially located extending from the upstream exhaust case flange 21 to at least the downstream exhaust case flange 18, and preferably extending to a downstream spool structure flange 70 extending radially outwardly from a downstream end of the spool structure 16. The convective cooling channel 48 is defined by a panel structure 72 that extends from an upstream location 74 where it is affixed to the exhaust section 10 at the upstream exhaust case flange 21 to a downstream location 76 where it is affixed to the exhaust section 10 at the downstream spool structure flange 70. The panel structure 72 is located in radially spaced relation to the outer case surface 68 to define a first cooling channel portion 78 of the convective cooling channel 48, i.e., a recessed area between the upstream exhaust case flange 21 and the downstream exhaust case flange 18. The panel structure 72 is further located in radially spaced relation to an outer surface 80 of the spool structure 16 to define a second cooling channel portion 82 of the convective cooling channel 48, i.e., a recessed area between the upstream spool structure flange 20 and the downstream spool structure flange 70. The first and second cooling channel portions 78, 82 define circumferentially parallel flow paths around the exhaust section 10 and may be in fluid communication with each other across the radially outer ends of the flanges 18, 20.

Figure 2A:
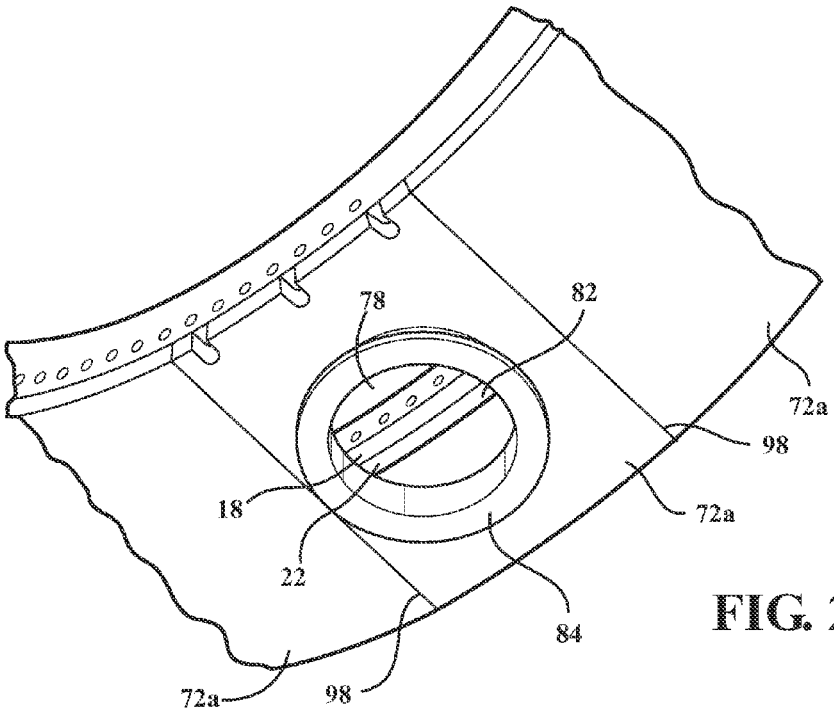
FIG. 2A is a perspective view of a lower portion of the structure illustrated in FIG. 2 illustrating a main air inlet.

Referring to FIGS. 2 and 3, the convective cooling channel 48 includes a main cooling air supply inlet 84 located at a first circumferential location for providing a supply of ambient air to the convective cooling channel 48. The convective cooling channel 48 further includes an exhaust air outlet 86 at a second circumferential location that is diametrically opposite from the first circumferential location. In accordance with a preferred embodiment, the main air supply inlet 84 (FIG. 2A) is located at a bottom-dead-center location of the outer case 11 of the exhaust section 10, and the exhaust air outlet 86 is located at a top-dead-center location of the outer case 11 of the exhaust section 10.

As seen in FIG. 2, the exhaust section 10 may be formed in two halves, i.e., an upper half 88 and a lower half 90, joined together at a horizontal joint 92. In accordance with an aspect of the invention, the panel structure 72 includes enlarged side portions 94 formed as box sections extending across the horizontal joints 92 from locations above and below the horizontal joints 92. The side portions 94 are configured to provide additional clearance for air flow around the horizontal joints 92, and may further be configured to provide an additional air flow to the convective cooling channel 48, as is discussed below.

The panel structure 72 comprises individual panel sections 72*a* that may be formed of sheet metal, i.e., relatively thin compared to the outer case 11. The panel sections 72*a* are curved to match the curvature of the outer case 11, and extend downwardly from the side portions 94 toward the main air inlet 84, and extend upwardly from the side portions 94 toward the air outlet 86. The panel sections 72*a* are formed as generally rectangular sections extending between the upstream and downstream locations 74, 76 on the exhaust section 10, and preferably engage or abut each other, as well as the side portions 94 at shiplap joints 98 along axially extending edges of the panel sections 72*a*. The panel sections 72*a* and side portions 94 may be attached to the exhaust section outer case 11 by any conventional means, and are preferably attached as removable components by fasteners, such as bolts or screws. It should be understood that although the enlarged side portions 94 are depicted as box sections, this portion of the panel structure 72 need not be limited to a particular shape and may be any configuration to facilitate passage of air flow past the horizontal joints 92, which typically comprise enlarged and radially outwardly extending flange portions of the exhaust section outer case 11. Further, it should be noted that the main air inlet 84 and the air outlet 86 may incorporated into respective panel sections 72*a* at respective bottom-dead-center and top-dead-center locations around the panel structure 72.

Figure 2B:
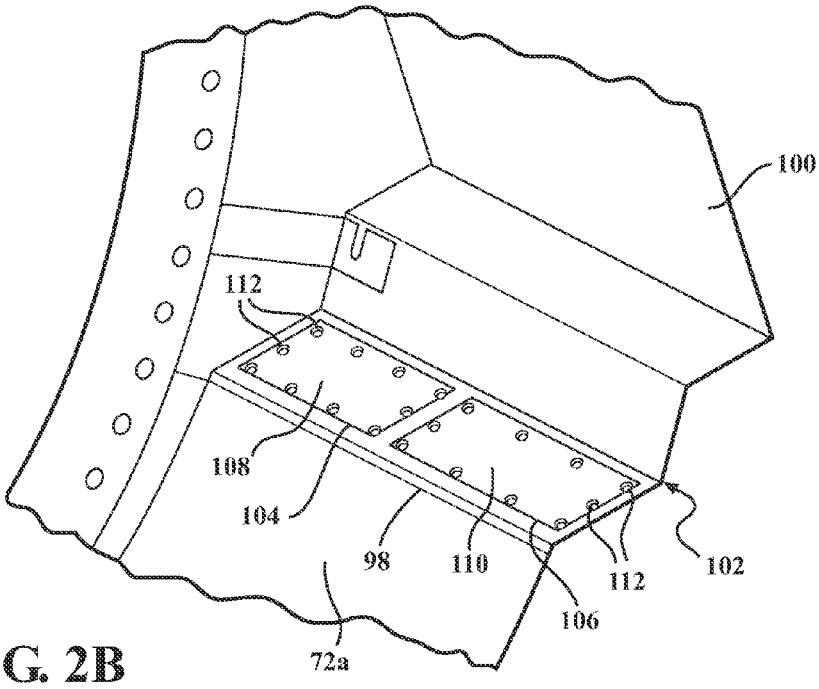
FIG. 2B is a perspective view from a lower side of the structure illustrated in FIG. 2 illustrating auxiliary air inlets.

Referring to FIGS. 2 and 2B, the side portions 94 may be formed with a lower portion 100 extending below the horizontal joints 92 and terminating at a downward facing auxiliary air inlet structure 102. The auxiliary air inlet structure 102 may include first and second auxiliary air inlet openings 104, 106 located side-by-side, each of which is illustrated as a downwardly facing opening in the panel structure 72. The first and second auxiliary air inlet openings 104, 106 may be axially aligned over the first and second channel portions 78, 82, respectively. The auxiliary air inlet openings 104, 106 are shown as being provided with respective cover panels or plates 108, 110 that may be removably attached over the openings with fasteners 112, such as bolts or screws. One or both of the cover plates 108, 110 may be displaced or removed from the auxiliary air inlet openings 104, 106 to permit additional or auxiliary ambient air 116 into the convective cooling channel 48 through the auxiliary air inlet structure 102, as is further illustrated in FIG. 3.

In accordance with an aspect of the invention, the convective cooling channel 48 receives a non-forced ambient air through the main air supply inlet 84. That is, air may be provided to the convective cooling channel 48 without a driving or pressure force at the air inlet 84 to convey air in a convective main air supply flow 114 from a location outside the gas turbine engine through the main air supply inlet 84. The main air supply inlet 84 may be sized with a diameter to extend across at least a portion of each of the first and second channel portions 78, 82, such that a portion of the main supply air flow 114 may pass directly into each of the channel portions 78, 82.

The ambient air flow into the convective cooling channel 48 provides a decreased thermal gradient around the circumference of the exhaust section 10 to reduce or minimize thermal stresses that may occur with a non-uniform temperature distribution about the exhaust section 10. In particular, stresses related to differential thermal expansion of the exhaust case 14, and transmitted to the struts 34, may be decreased by the increased uniformity of the cooling flow provided by the convective cooling channel 48. Further, the operating temperature of the exhaust case 14 may be maintained below the material creep limit to avoid associated case creep deformation that may cause an increase in strut stresses.

A multiport cooling configuration may be provided for the convective cooling channel 48 by displacing or removing one or more of the cover plates 108, 110 of the auxiliary air inlet structure 102 to increase the number of convective cooling air supply locations. Hence, the amount of cooling provided to the channel portions 78, 82 may be adjusted on turbine engines located in the field to increase or decrease cooling by removal or replacement of the cover plates 108, 110. For example, it may be desirable to provide an increase in the cooling air flow by removing one or more of the cover plates 108, 110, or it may be desirable to provide a decrease in air flow by replacing one or more of the cover plates 108, 110 to prevent or decrease the auxiliary air flow 116, depending on increases or decreases in the ambient air temperature. Further, the cover plates 108, 110 may be used optimize the temperature of the exhaust case 14 and spool structure 16 to minimize any thermal mismatch between adjacent hardware and components.

The exhaust air outlet 86 is located at the top of the convective cooling channel 48, such that the heated exhaust air 118 may flow by convection out of the convective cooling channel 48. The exhaust air outlet 86 may be sized with a diameter to extend across at least a portion of each of the first and second channel portions 78, 82, such that the heated air exhausting from the convective cooling channel 48 may be conveyed directly to the exhaust air outlet 86 from each of the channel portions 78, 82. Subsequently, the heated air passing out of the exhaust air outlet 86 may be exhausted out of existing louver structure (not shown) currently provided for existing gas turbine engine units.

It should be understood that the convective air flow through the convective cooling channel 48 comprises a cooling air flow that may be substantially driven by a convective force produced by air heated along the outer case surface 68 and outer surface 80 of the spool structure 16. The heated air within the convective cooling channel 48 rises by natural convection and is guided toward the exhaust air outlet 86. As the air rises within the convective cooling channel 48, it draws ambient air into the channel 48 through the main cooling air supply inlet 84, effectively providing a driving force for a continuous flow of cooling air upwardly around the outer surface of the outer case 11. Similarly, when either or both of the auxiliary air inlet openings 104, 106 on the sides of the panel structure 72 are opened, natural convection will draw the air upwardly around the channel 48 through the auxiliary air inlet structure 102 to the exhaust air outlet 86.

It may be noted that as the cooling air flows upwardly as a convection air flow 48, a lower pressure will be created within the convective cooling channel 48 than the ambient air pressure outside the convective cooling channel 48. Hence, any leakage at the panel joints 98, or the joints 97, 99 (FIG. 2) where the edges of the panel segments 72*a* are mounted to the exhaust section 10 at the upstream and downstream locations 74, 76, will occur inwardly into the convection cooling channel 48. In this regard, it may be understood that it is not necessary to provide a leakage-proof sealing at the peripheral edges of the panel segments 72*a* and side portions 94, and that leakage into the convective cooling channel 48 may be viewed as an advantage facilitating the cooling function of the thermal barrier/cooling system 44.

Optionally, as is illustrated diagrammatically in FIG. 3, a fan unit 120 may be provided connected to the exhaust air outlet 86. The fan unit 86 may provide additional air flow from the exhaust air outlet 86 to increase the cooling capacity of the convective cooling channel 48, while maintaining an ambient airflow into and through the convective cooling channel 48. Alternatively, or in addition, an inlet fan unit (not shown) may be provided to the main cooling air supply inlet 84 to provide an increase in the ambient airflow into the channel 48. It should be understood that even with the provision of a fan unit to facilitate flow through the convective cooling channel 48, i.e., a fan unit 120 at the outlet 86 and/or a fan unit at the inlet 84, the movement of the air flow through the channel 48 may create a reduced pressure within the channel 48 relative to the ambient area surrounding the outside of the outer case 11.

Figure 4:
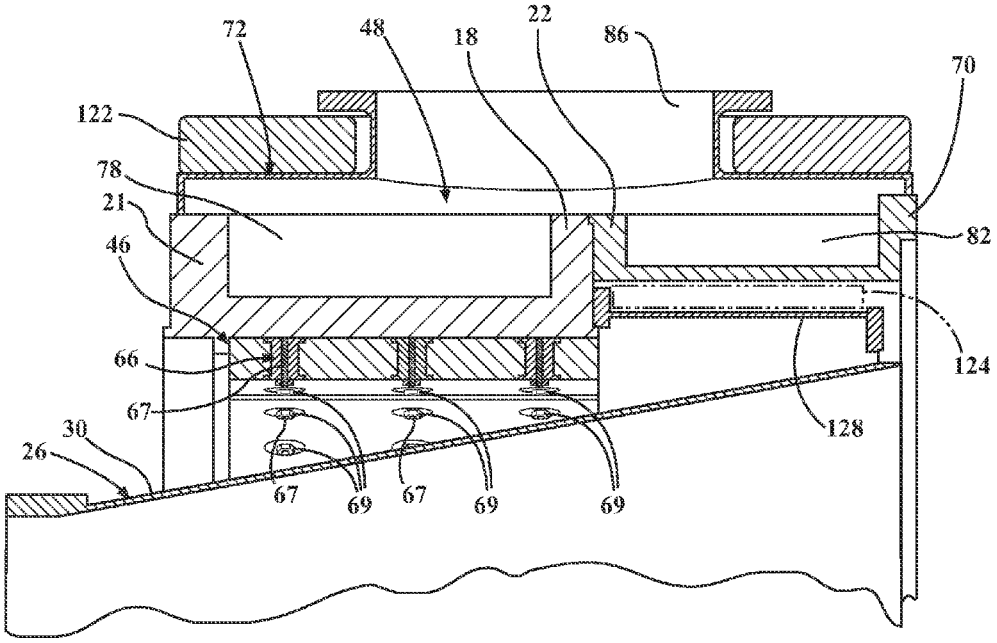
FIG. 4 is a cut-away perspective view of a portion of the exhaust section adjacent to a top-dead-center location of the exhaust section.

The convective cooling channel 48 may further be provided with an external insulating layer 122, as seen in FIGS. 1, 3, and 4 (not shown in FIG. 2). The external insulating layer may cover substantially the entire exterior surface of the panel structure 72 defined by the panel segments 72*a* and side portions 94, and has a low thermal conductivity to generally provide thermal protection to personnel working or passing near the exhaust section 10.

Referring to FIG. 4, an optional further or second internal insulating layer 124 may be provided to the spool structure 16, extending circumferentially around an inner spool segment surface 126, radially outwardly from a Z-plate or spring plate structure 128 provided for supporting the diffuser 26. The second internal insulating layer 124 may comprise separate insulating layer segments having a construction and thermal conductivity similar to that described for the internal insulating layer 46. Further, the second internal insulating layer 124 may be mounted to the inner spool segment surface 126 in a manner similar to that described for the insulating layer segments 46*a* of the internal insulating layer 46. The second internal insulating layer 124 may be provided to limit or minimize an amount of radiated heat transmitted from the diffuser 26 to the spool structure 16. Hence, the convective air flow requirement for air flowing through the second portion 82 of the convective cooling channel 48 may be reduced by including the second internal insulating layer 124.

As described above, the thermal barrier/cooling system 44 provides a system wherein the internal insulating layer 46 substantially reduces the amount of thermal energy transferred to the outer case 11 of the exhaust section 10, and thereby reduces the cooling requirement for maintaining the material of the outer case 11 below its creep limit. Hence, the external cooling configuration provided by the convective cooling channel 48 provides adequate cooling to the outer case 11 with a convective air flow, with an accompanying reduction or elimination of the need for forced air cooling provided to the interior of the outer case 11. Elimination of forced air cooling to the interior of the outer case 11, i.e., by maintaining supply and exhaust of cooling air external to the outer case 11, avoids problems associated with thermal mismatch or thermal gradients between components within the outer case 11.

Additionally, since the air supply for cooling the outer case 11 does not draw on compressor bleed air or otherwise directly depend on a supply of the air from the gas turbine engine, the present thermal barrier/cooling system 44 does not reduce turbine power, such as may occur with systems drawing compressor bleed air, and the cooling effectiveness of the present system operates substantially independently of the engine operating conditions. Hence, the present invention may be implemented without drawing on the secondary cooling air of the gas turbine engine, and may provide a reduced requirement for usage of secondary cooling air with an associated increase in overall efficiency in the operation of the gas turbine engine.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

an outer case comprising a turbine exhaust case defining a central longitudinal axis, the exhaust case having an upstream exhaust case flange, a downstream exhaust case flange, and an outer case surface between the upstream and downstream exhaust case flanges extending circumferentially around the central longitudinal axis, the upstream and downstream exhaust case flanges extending radially outward from the outer case surface;

a thermal barrier/cooling system for controlling a temperature of the outer case, the thermal barrier/cooling system including:

an internal insulating layer supported on an inner case surface opposite the outer case surface and spanning axially from the upstream exhaust case flange to the downstream exhaust case flange, the internal insulating layer extending circumferentially along the inner case surface and providing a thermal resistance to radiated energy from structure located radially inwardly from the outer case; and a convective cooling channel defined by a panel structure located in radially spaced relation to the outer case surface and extending continuously around the circumference of the outer case surface and located within a space defined between the upstream and downstream exhaust case flanges, the convective cooling channel is axially aligned with the internal insulating layer and forms a flow path for an ambient air flow cooling the outer case surface.

2. The gas turbine engine of claim 1, wherein the convective cooling channel includes a cooling air supply inlet at a first circumferential location, and an exhaust air outlet at a second circumferential location diametrically opposite from the first circumferential location.

3. The gas turbine engine of claim 2, wherein the axis of the outer case extends in a generally horizontal direction, and the air supply inlet is located at a bottom-dead-center location of the outer case and the exhaust air outlet is located at a top-dead-center location of the outer case.

4. The gas turbine engine of claim 3, including auxiliary air inlets located about midway between the first and second circumferential locations on opposing sides of the outer case, and providing entry of ambient air into the convective cooling channel.

5. The gas turbine engine of claim 4, including cover plates located over the auxiliary air inlets, the cover plates being displaceable from the auxiliary air inlets to permit entry of ambient air into the cooling channel through one or more of the auxiliary air inlets.

6. The gas turbine engine of claim 1, including an external insulating layer supported on and covering the panel structure.

7. A gas turbine engine comprising:

an outer case defining a central longitudinal axis, and an outer case surface extending circumferentially around the central longitudinal axis;

a thermal barrier/cooling system for controlling a temperature of the outer case, the thermal barrier/cooling system including:

an internal insulating layer supported on an inner case surface opposite the outer case surface, the internal insulating layer extending circumferentially along the inner case surface and providing a thermal resistance to radiated energy from structure located radially inwardly from the outer case; and a convective cooling channel defined by a panel structure located in radially spaced relation to the outer case surface and extending around the circumference of the outer case surface, the convective cooling channel is generally axially aligned with the internal insulating layer and forms a flow path for an ambient air flow cooling the outer case surface; and the panel structure comprises a plurality of circumferentially located panel segments joined at axially extending joints, the air flow through the cooling channel creating a pressure lower than an ambient air pressure such that any air leakage through the joints comprises leakage of ambient air into the cooling structure.

8. The gas turbine engine of claim 1, wherein the internal insulating layer comprises a plurality of circumferentially located separately mounted insulating layer segments.

9. The gas turbine engine of claim 1, wherein the outer case comprises a turbine exhaust case, and including an exhaust diffuser defining the structure located radially inwardly from the outer case at the axial location of the internal insulating layer.

10. A gas turbine engine comprising:

an outer case comprising a turbine exhaust case defining a central longitudinal axis extending in a generally horizontal direction, the exhaust case having an upstream exhaust case flange, a downstream exhaust case flange, and an outer case surface between the upstream and downstream exhaust case flanges extending circumferentially around the central longitudinal axis, the upstream and downstream exhaust case flanges extending radially outward from the outer case surface;

a thermal barrier/cooling system for controlling a temperature of the outer case, the thermal barrier/cooling system including:

an internal insulating layer supported on an inner case surface opposite the outer case surface and spanning axially from the upstream exhaust case flange to the downstream exhaust case flange, the internal insulating layer extending circumferentially along the inner case surface and providing a thermal resistance to radiated energy from an exhaust diffuser located radially inwardly from the outer case; and a convective cooling channel including at least a first portion defined by a panel structure located in radially spaced relation to the outer case surface and extending continuously around the circumference of the outer case surface and located within a space defined between the upstream and downstream exhaust case flanges, and the convective cooling channel is axially aligned with the internal insulating layer and forms a flow path for directing an ambient non-forced air flow in an upward direction to cool the outer case surface.

11. The gas turbine engine of claim 10, wherein the convective cooling channel includes a cooling air supply inlet at a first circumferential location at a bottom-dead-center location of the outer case, and an exhaust air outlet at a second circumferential location at a top-dead-center location of the outer case.

12. The gas turbine engine of claim 11, including auxiliary air inlets located about midway between the first and second circumferential locations on opposing sides of the outer case, and providing entry of ambient air into the convective cooling channel.

13. The gas turbine engine of claim 12, including cover plates located over the auxiliary air inlets, the cover plates being displaceable from the auxiliary air inlets to permit entry of ambient air into the cooling channel through one or more of the air inlets.

14. The gas turbine engine of claim 10, wherein the panel structure comprises an external insulating layer located radially outwardly from the cooling channel.

15. The gas turbine engine of claim 10, wherein the panel structure comprises a plurality of circumferentially located panel segments joined at axially extending joints, the air flow through the cooling channel creating a pressure lower than an ambient air pressure such that any air leakage through the joints comprises leakage of ambient air into the cooling structure.

16. The gas turbine engine of claim 10, wherein the internal insulating layer comprises a plurality of circumferentially located separately mounted insulating layer segments.

17. The gas turbine engine of claim 16, wherein the insulating layer segments each comprise a pair of sheet metal layers and a thermal blanket layer located between the sheet metal layers, the thermal blanket layer having a lower thermal conductivity than the sheet metal layers.

18. The gas turbine engine of claim 10, including bearing support struts extending from the outer case, and through the internal insulating layer and the exhaust diffuser.

19. The gas turbine engine of claim 10, wherein the internal insulating layer has a thermal conductivity of about 0.15 W/m·K or less.

20. The gas turbine engine of claim 10, including a spool structure having a spool structure flange forming a joint with the downstream exhaust case flange, the thermal barrier/cooling system further comprising:

a second internal insulating layer supported on an inner surface of the spool structure, the internal insulating layer extending circumferentially along the inner surface of the spool structure and providing a thermal resistance to radiated energy from the exhaust diffuser; and the panel structure extending past the joint between the downstream exhaust case flange and the spool structure flange to form a second portion of the convective cooling channel extending around the circumference of the spool structure, and the second portion of the convective cooling channel is generally axially aligned with the second internal insulating layer and forms a second flow path for directing an ambient non-forced air flow in an upward direction to cool the spool structure surface.

* * * * *